US005783982A

United States Patent [19]

Lecheler

[11] Patent Number: 5,783,982

[45] Date of Patent: Jul. 21, 1998

[54] TRANSFORMER WITH CAP OVER WINDINGS

[75] Inventor: Reinhard Lecheler, Neuburg an der Donau, Germany

[73] Assignee: Patent-Treuhand-Gesellschaft fur elektrische Gluelampen mbH, Munich, Germany

[21] Appl. No.: 804,704

[22] Filed: Feb. 21, 1997

[30] Foreign Application Priority Data

Feb. 29, 1996 [DE] Germany ..... 196 07 714.1

[51] Int. Cl.[6] ..... H01F 27/02; H01F 27/30

[52] U.S. Cl. ..... 336/9; 336/198

[58] Field of Search ..... 336/198, 208, 336/90, 192

[56] References Cited

U.S. PATENT DOCUMENTS

| | | | |
|---|---|---|---|
| 3,750,072 | 7/1973 | Weiner | 336/208 |
| 3,909,761 | 9/1975 | Miles | 336/208 |
| 4,405,913 | 9/1983 | Finkbeiner | 336/198 |
| 4,716,394 | 12/1987 | Gordon | 336/198 |
| 4,980,664 | 12/1990 | Harwood | 336/192 |
| 5,534,839 | 7/1996 | Mackin et al. | 336/208 |

FOREIGN PATENT DOCUMENTS

| | | | |
|---|---|---|---|
| 3241408A1 | 5/1984 | Germany . | |
| 9103712 | 8/1991 | Germany . | |
| 61-168617 | 10/1986 | Japan | 336/198 |

*Primary Examiner*—Thomas J. Kozma
*Attorney, Agent, or Firm*—Carlo S. Bessone

[57] ABSTRACT

The invention relates to a transformer with at least one primary winding and at least one secondary winding, with a winding unit, on which the primary winding is arranged in a first chamber and on which the secondary winding is arranged in a second chamber, in which a core, particularly a ferrite core, can be introduced, and which has an uptake element for a cap. The invention provides that the cap covers only a partial region of the primary winding and the secondary winding. The primary winding and secondary winding are adjacent to each other in this partial region. The cap is configured with a first separating wall arranged essentially perpendicular to the cap, and this wall is arranged between the first chamber and the second chamber in the assembled state.

18 Claims, 14 Drawing Sheets

A : A

A : A

A : A

TRANSFORMER WITH CAP OVER WINDINGS

FIELD OF THE INVENTION

The invention relates to a transformer including a winding unit on which a primary winding and a secondary winding are arranged. The winding unit has an uptake element for a cap.

BACKGROUND OF THE INVENTION

Transformers are used in the most varied fields. Among these, transformers are used for the operation of halogen incandescent lamps, whereby an input voltage of, e.g., 230 volts or 240/245 volts, is transformed into an output voltage of 6 volts, 12 volts or 24 volts. Output transformers in electronic converters for halogen lamps transform from one-half the mains voltage (e.g., 115 volts) to, e.g., 12 volts.

A winding unit and a cap, each of plastic, are offered for such transformers, e.g., by the company NORWE, Ing. Norbert Weiner GmbH and described in a product prospectus "Safety Class Coil Units UNI", 11/1991. The known transformer is constructed in a relatively complex manner. The cap is made up in one piece with relatively thin walls. In addition to the relatively complex structure, another disadvantage of the known transformer consists of the fact that the assembly of the transformer-winding unit, on the one hand, and the part comprised of the cap and the walls, on the other hand, is difficult, since many points of the winding unit must be correctly positioned opposite the corresponding points of the part consisting of cap and walls prior to joining and the walls can be easily mechanically bent relative to one another.

Another disadvantage of the known transformer consists of the fact that, particularly with continuous operation, the increase in temperature of the windings and the plastic surfaces that bound them is relatively high. The known transformer can thus only be operated up to an appropriately reduced ambient temperature, for which a continuous insulation capacity is still assured.

SUMMARY OF THE INVENTION

Proceeding from this state of the art, the object of the invention is to provide a transformer, which assumes lower temperature values.

This object is accomplished according to the invention by a transformer, which is defined in the patent claims.

The transformer of the invention is configured such that, on the one hand, most of the evolved heat is discharged, and that, on the other hand, however, a sufficiently good insulation is assured between the primary and secondary windings.

The maximally permissible ambient temperature of the transformer thus can be increased, or if the maximally permissible ambient temperature essentially remains the same, less expensive transformer components (windings, core) with higher heat evolution can be used.

At the same time, the cap or the components that are preferably made up in one piece with it, i.e., a first separating wall and a second separating wall are also configured such that the assembly of the winding unit and the cap is made possible in a simple way.

A first coding element, which is arranged on the winding unit, and a second coding element, which corresponds to the first coding element and is arranged on the cap or on a component joined with it serve for a simple and defect-free assembly of the winding units with differently designed chambers for the primary winding or the secondary winding, on the one hand, and the cap, on the other hand.

The production of the cap and the winding unit is relatively simple in injection technology due to their wall thickness; no special requirements are placed on the injection molding dies. No sliders are necessary for the cap die. Overall, relatively small die costs result.

An insulating ridge, which is provided on the winding unit, also serves for the good insulation properties of the transformer of the invention.

The transformer of the invention is further configured in such a way that the production of safe small voltages (Safety Extra Low Voltage SELV) is made possible.

BRIEF DESCRIPTION OF THE DRAWINGS

The present invention will first be generally described in the following and then the invention will be explained in more detail in conjunction with the figures, based on a preferred example of embodiment. Here

BEST MODE FOR CARRYING OUT THE INVENTION

Figure 1:
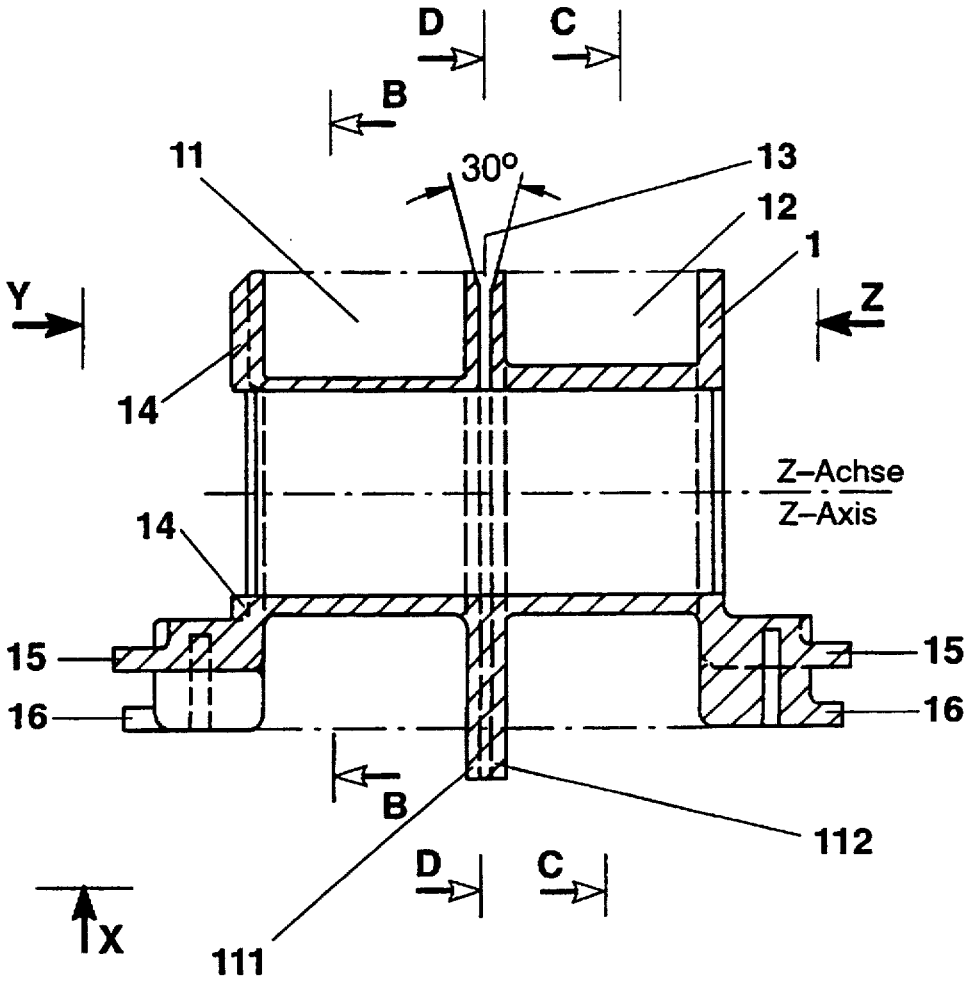
FIGS. 1–9 show a winding unit for a form of embodiment of the transformer of the invention.

The invention concerns a transformer, which is particularly driven in a frequency region above the mains frequency. The transformer has at least one primary winding and at least one secondary winding as well as a winding unit 1 (FIGS. 1–9, 16–24), on which the primary winding is arranged in a first chamber 11 and on which the secondary winding is arranged in a second chamber 12.

A core 2 (FIGS. 16, 20, 22 and 24), which is particularly a ferrite core in the preferred operating range (with frequencies above the mains frequency) can be introduced into the winding unit.

The winding unit has an uptake element 13 (FIGS. 1–3, 6), particularly a groove, which holds a cap 3 (FIGS. 10–17, 19, 21 and 24).

Cap 3 (FIG. 16) covers only a partial region of the primary winding, which is wound up in first chamber 11, and a partial region of the secondary winding, which is wound up in second chamber 12. This is the partial region, in which the primary winding and the secondary winding are adjacent to one another. Cap 3 is thus configured such that most of the heat evolved in the two windings is discharged. In the region of the two windings, which is not covered by the cap, the heat is yielded directly in the vicinity of the transformer. On the other hand, however, the cap, due to its dimensions, assures a sufficiently good insulation between the primary and secondary windings; a ("first") air and leakage distance between the primary and secondary windings runs along the cap and amounts to at least 4.5 millimeters, particularly 4.8 millimeters. The first air and leakage distance runs, on the one hand, from the primary winding over cap 3 to the secondary winding (or also in the reverse direction); on the other hand, the first air and leakage distance runs from the primary winding over a first chamber wall 111, a first separating wall 31, and a second chamber wall 112 to the secondary winding. Further, the first air and leakage distance runs, on the one hand, from the primary winding below a plate 32 (FIGS. 10–16) to the secondary winding, and, on the other hand, from the primary winding horizontally over uptake element 13.

With respect to the first-named course of the first air and leakage distance, the width of the cap surface amounts to at least 4.5 millimeters; a preferred value amounts to 4.8 millimeters. Even at this value and even with an unfavorable arrangement of the windings (windings, which should be arranged next to one another, are actually arranged on top of one another), a sufficient insulation will be formed.

Cap 3 is configured with first separating wall 31 arranged essentially perpendicularly to cap 3 (FIGS. 16 and 24), and this separating wall is arranged in the assembled state between first chamber 11 or first chamber wall 111 and second chamber 12 or second chamber wall 112. Thus, the air and leakage distance is extended in a meandering way over the first separating wall. The wall thickness of the first or second chamber wall amounts, to e.g., 0.4 millimeter, and the wall thickness of the first separating wall amounts to 0.6 millimeter.

Preferably, cap 3 and first separating wall 31 are formed in one piece. In particular, cap 3 and first separating wall 31 are also formed in one piece with a plate 32 (FIGS. 10–13, 16, 19–24), on which the core is placed in the assembled state, and is formed in one piece with second separating walls 33. Plate 32 is arranged parallel to cap 3. Second separating walls 33 join cap 3 and plate 32 with each other in such a way that plate 32, second separating walls 33, and cap 3 form a stepped structure. The stability of the complex 3-31-33-32 is particularly obtained by plate 32.

First chamber 11 has first chamber wall 111 on its side turned toward second chamber 12, whereas second chamber 12 has second chamber wall 112 on its side turned toward first chamber 11 (FIG. 1). Thus, a double-walled structure is provided between the primary and secondary windings, whereby first separating wall 31 is also introduced between the two chamber walls.

Both chamber walls 111 and 112 are set in a parallel manner and at a distance to one another such that first separating wall 31 is arranged in the assembled state at least in a partial region between the two chamber walls 111, 112.

First separating wall 31 is configured in a U-shape (FIG. 12), whereby the U legs of separating wall 31 laterally surround the mid-section of core 2 in the assembled state.

The already mentioned second separating walls 33, which are preferably formed in one piece with the cap, serve for insulating the first or the second winding relative to core 2.

A second air and leakage distance runs between the primary winding and core 2, on the one hand, and between the secondary winding and core 2, on the other hand; it preferably amounts to at least 2.0 mm and particularly 3 mm.

The second air and leakage distance is extended by second separating walls 33, which particularly project approximately 2.5 mm–2.8 mm over the upper side of core 2.

The first and second chambers of winding unit 1 are in particular of different size (chamber 1 is larger than chamber 2). In this case, a first coding element 14 (FIGS. 1, 17; e.g., a projecting piece) is arranged on winding unit 1, which element corresponds with a second coding element 34 (FIG. 11), which is arranged on cap 3 or a part (e.g. 33) joining with the cap.

The first and second chambers of winding unit 1 are particularly not only of different size, but are also insulated in different ways; the insulating thickness between the primary winding and core amounts to 0.4 mm (refer to the shaded region in FIG. 5, side regions and upper region), whereas the insulating thickness between secondary winding and core (refer to the shaded region in FIG. 8) amounts to 0.8 mm. This configuration offers advantages for the placement of the transformer (a smaller insulation of the structural components on the boards, which are joined with the primary winding, are necessary relative to the core).

Figure 22:
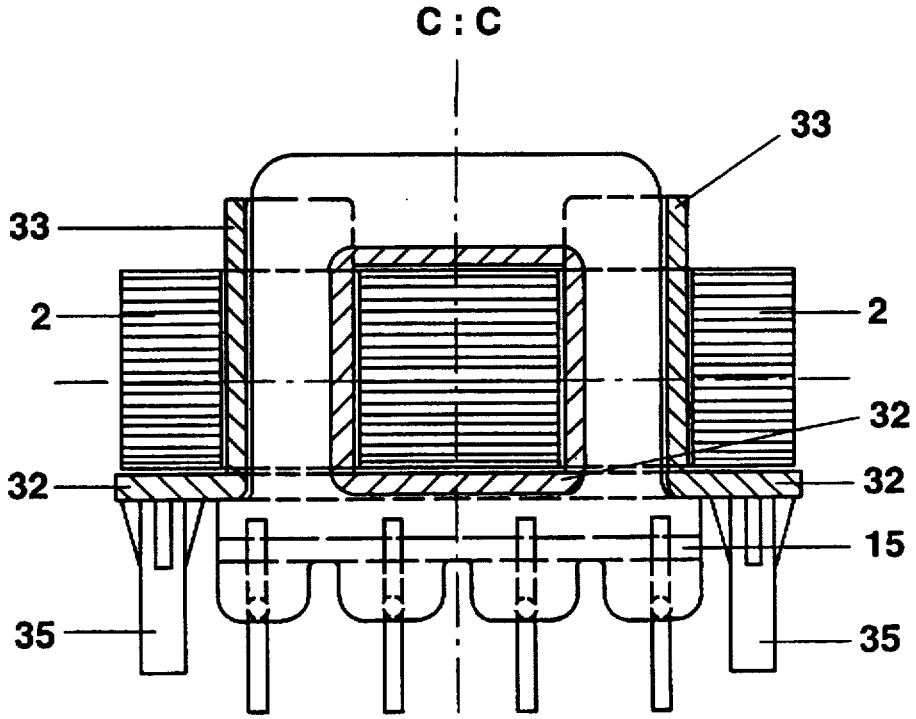

Winding unit 1 of the transformer has an insulating ridge 15 (FIGS. 1, 4, 7), which is arranged horizontally and thus parallelly to core 2 (FIG. 22).

Spacers 35 (FIGS. 10–13, 16, 19–24), which serve for attaching the transformer to a circuit board, are arranged on plate 32.

The invention also concerns cap 3 (FIGS. 10–19, 21–24) or the complex 3-31-33-32 as well as the corresponding winding unit 1 (FIGS. 1–9).

The relatively simple assembly of complex 3-31-33-32 as well as the corresponding winding unit 1 results from the fact that only the first separating wall 31 must be correctly positioned relative to the uptake element (groove) 13 prior to sliding together the two parts 3-31-33-32 and 1.

The construction of winding unit 1, cap 3, as well as the entire transformer with ferrite core 2 is shown in detail in the figures.

Figure 10:
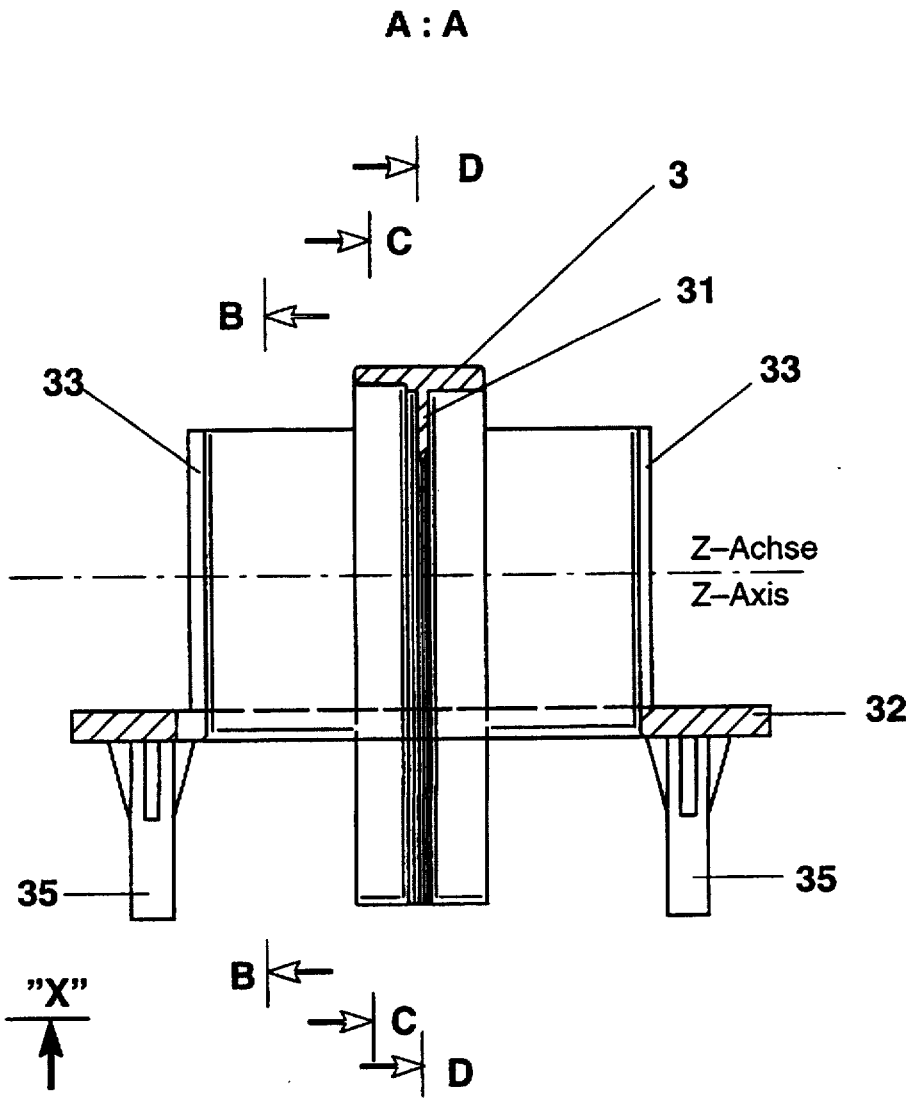
FIGS. 10–15 show a cap for one form of embodiment of the transformer according to the invention.

Winding unit 1 is shown in FIG. 1, and this has a first chamber 11 and a second chamber 12. A first chamber wall 111 of first chamber 11 and a second chamber 112, of second chamber 12 are directly adjacent, parallel, and distanced in such a way that a first separating wall (31; FIG. 10) is arranged between the first and second chambers in the assembled state. Two insulating ridges 15, which are configured horizontally in the case of the position of the winding unit shown in FIG. 1, are formed on winding unit 1. The insulating ridges are arranged in such a way that an air and leakage distance of at least 3 mm in length is forcibly obtained between the wires guided around wire wind-up mandrel 16 and a (ferrite) core introduced in the coil or winding unit 1; these are arranged in such a way that even in the case of fluctuations of the winding wire position caused during manufacture, a sufficient insulation is given.

Figure 15:
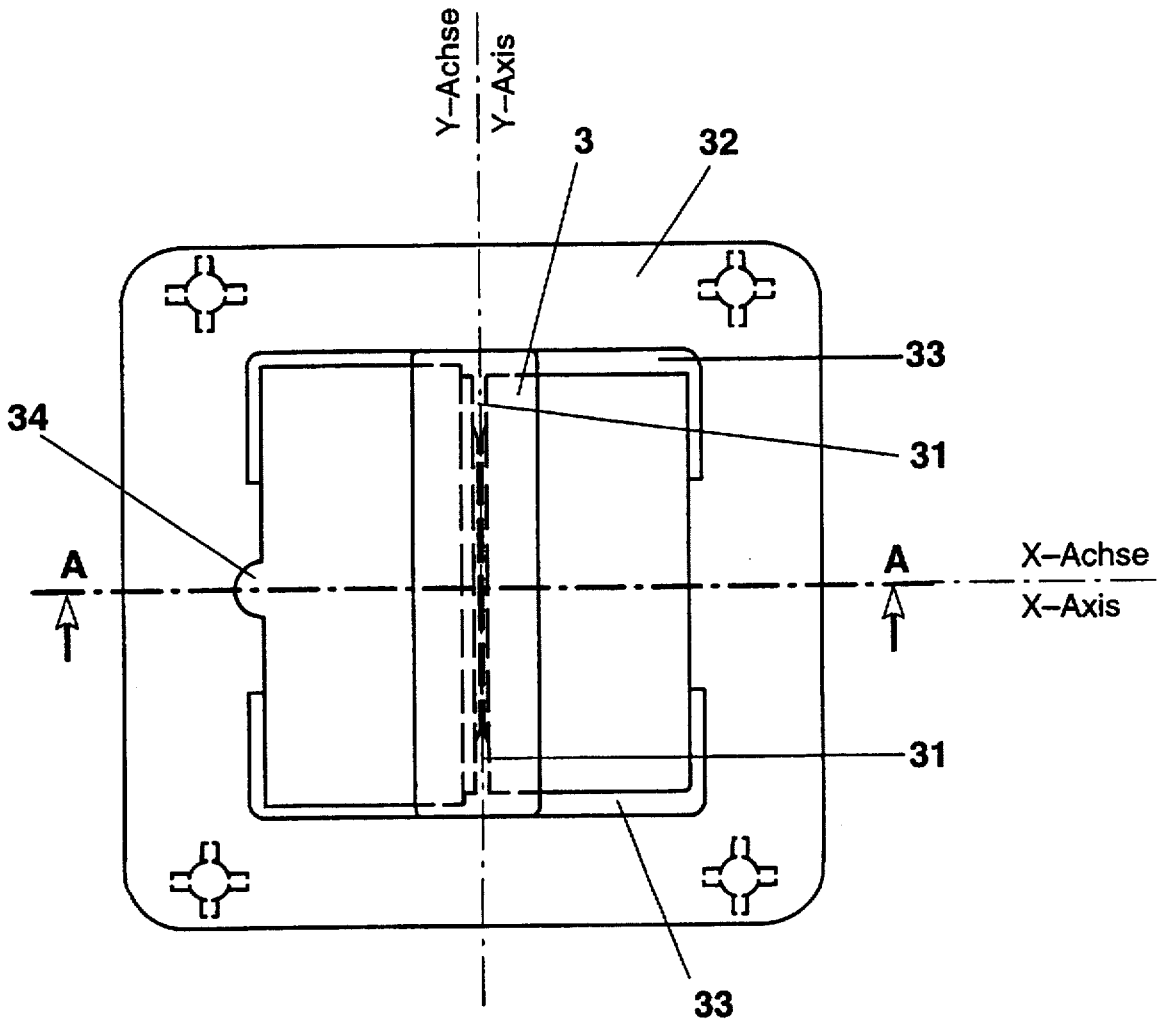

Further, FIG. 1 shows a projecting piece 14 ("first coding element"), which is formed on winding unit 1, and which corresponds to a second coding element (34; FIG. 15), which is arranged on the cap or on a part combined with the cap. Further, an uptake element 13, which is configured as a groove, is also shown in the figure, and this serves for uptake of the actual cap (3; FIG. 10).

Figure 2:
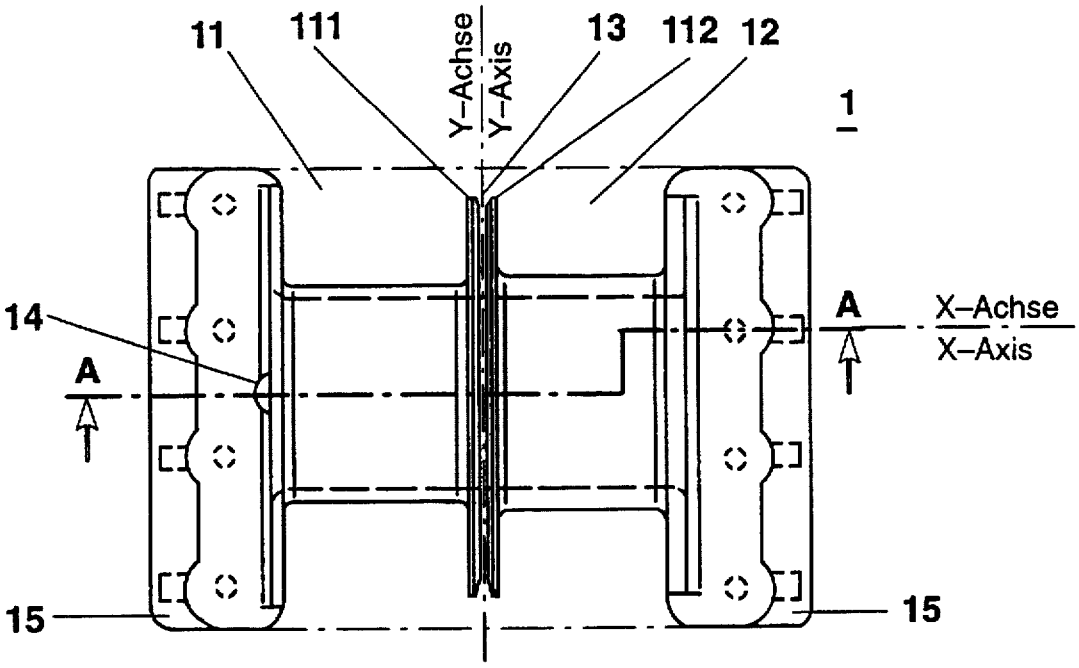

FIG. 2 shows a top view onto winding unit 1 according to FIG. 1, with the components shown and described therein.

Figure 3:
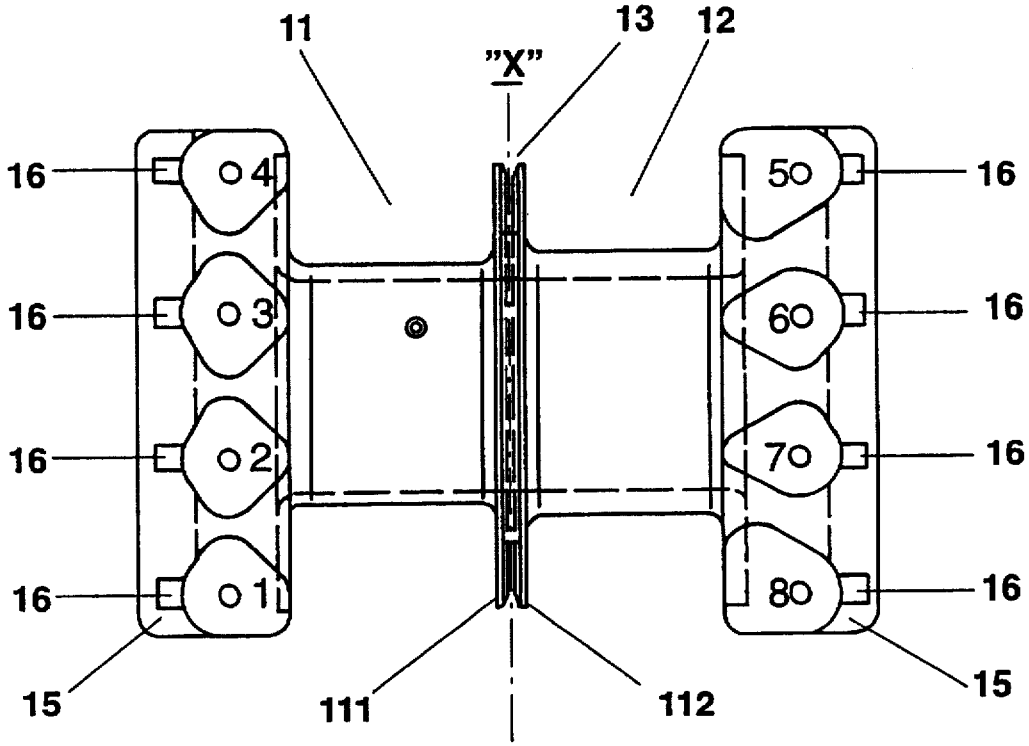

FIG. 3 shows a view of the winding unit from below, whereby numbers 1–8 from connections are impressed in the winding unit.

Figure 4:
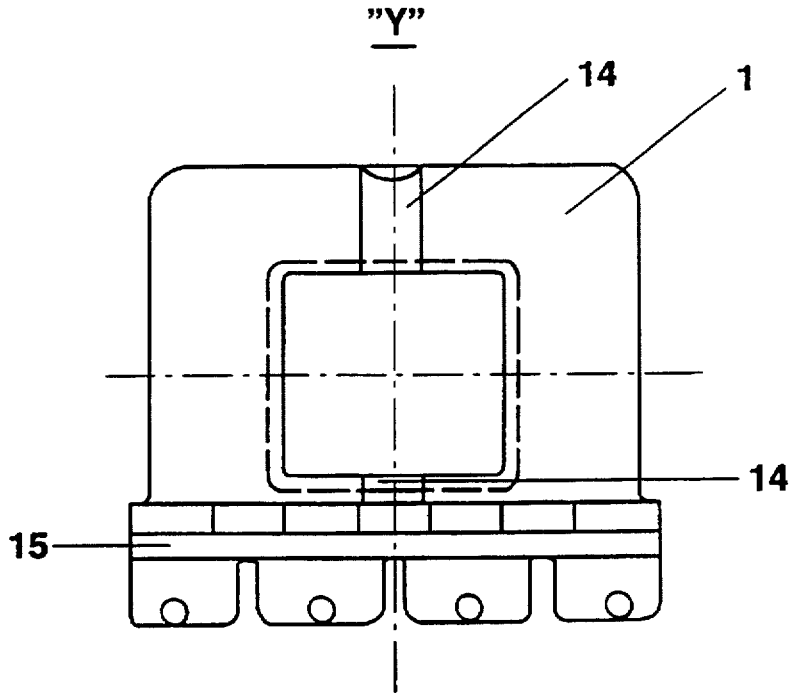

FIG. 4 shows a lateral view onto the winding unit, whereby first coding element 14 in the upper and lower region of winding unit 1 as well as an insulating ridge 15 are shown.

Figure 5:
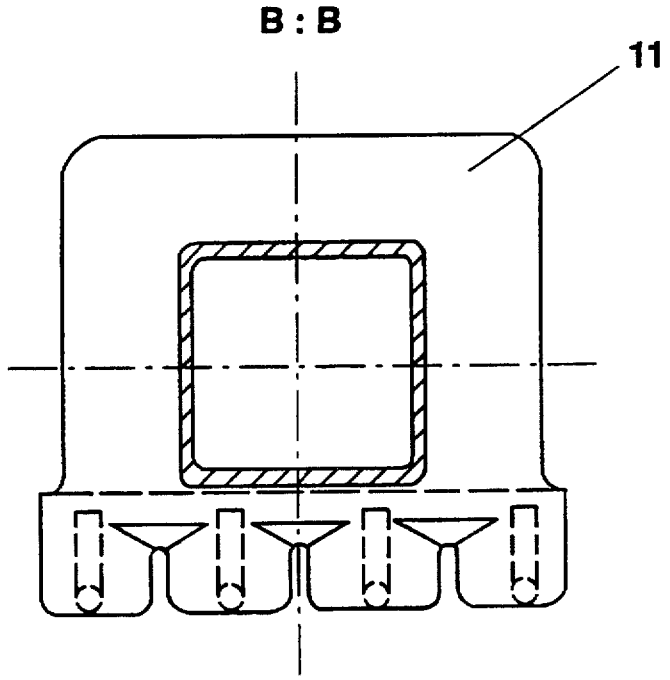
Figure 6:
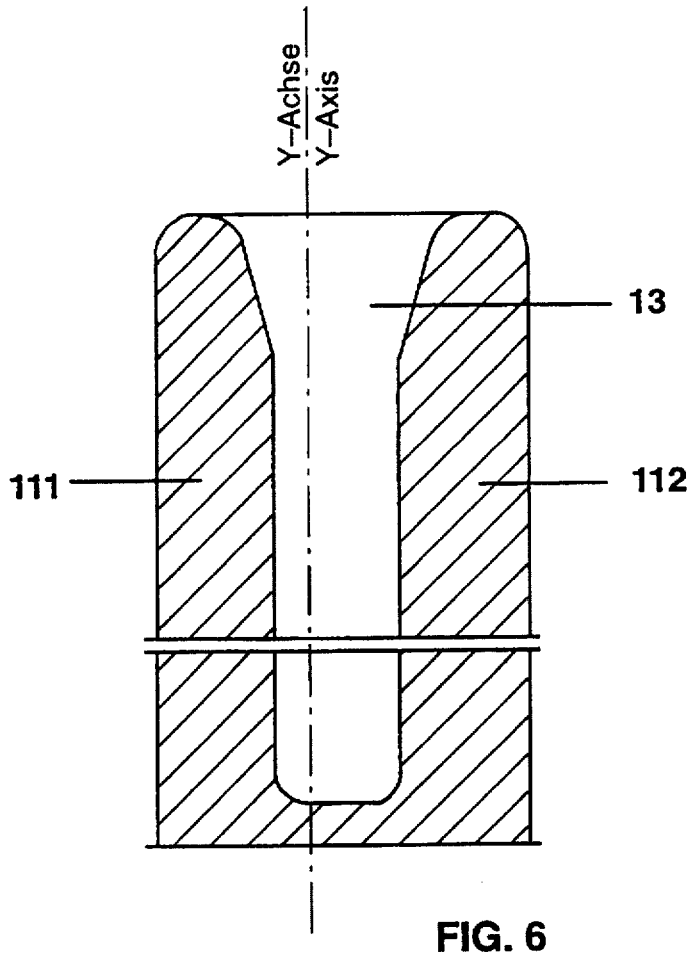
Figure 7:
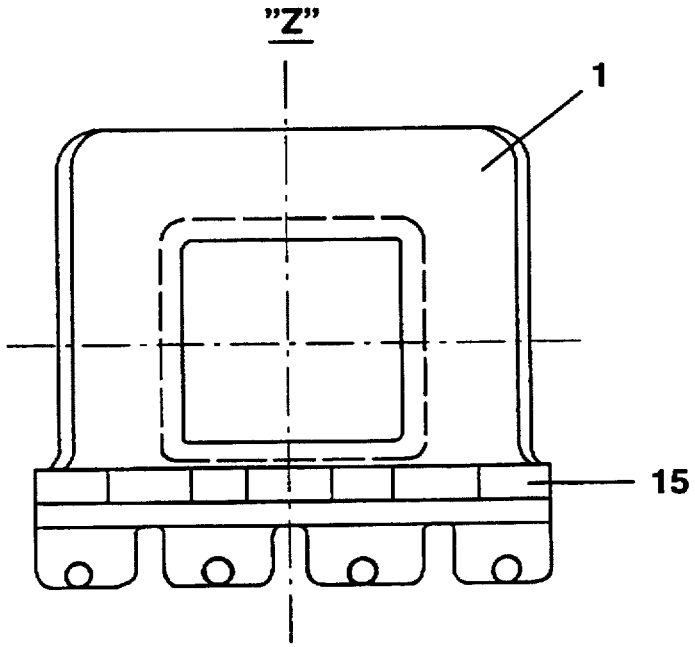

FIG. 5 shows the inside of first chamber 11, and FIG. 6 shows the configuration of the first and second chamber walls 111, 112, which form uptake element 13 for uptake of the actual cap.

FIG. 7 shows again a lateral view of the winding unit with an insulating ridge 15.

Figure 8:
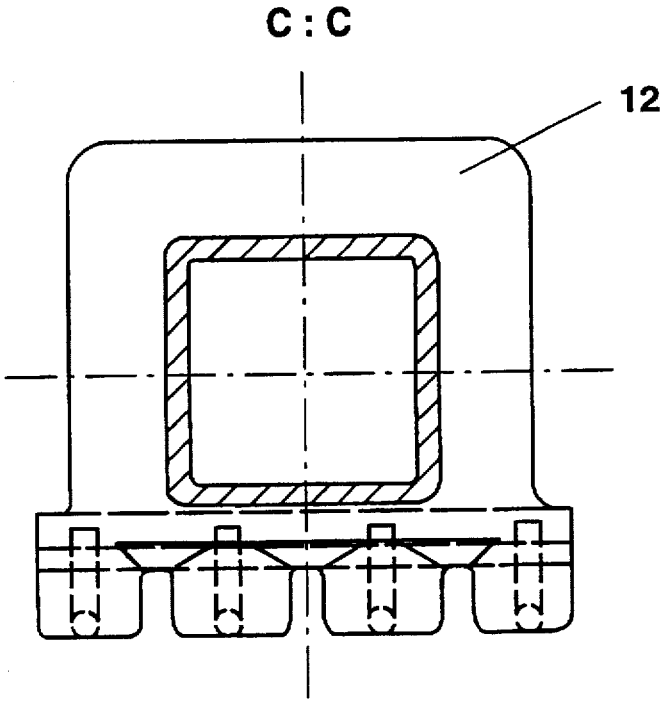
Figure 9:
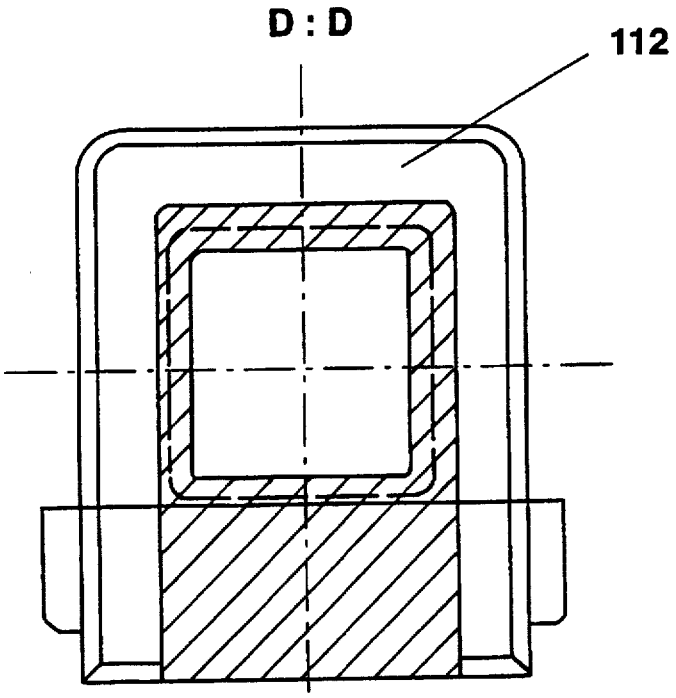

FIG. 8 shows the inside of second chamber 12 and FIG. 9 also shows the inside of second chamber 12 with second chamber wall 112.

FIG. 10 shows cap 3, which is formed with a separating wall 31, with side walls, as well as with an essentially horizontal plate 32. Thus the complex of cap 3, separating walls 31, 33 and plate 32 is sufficiently stable mechanically. Plate 32 is preferably 1 millimeter thick. It serves as the bearing surface for (ferrite) core 2 as well as a carrier for spacers 35.

Figure 11:
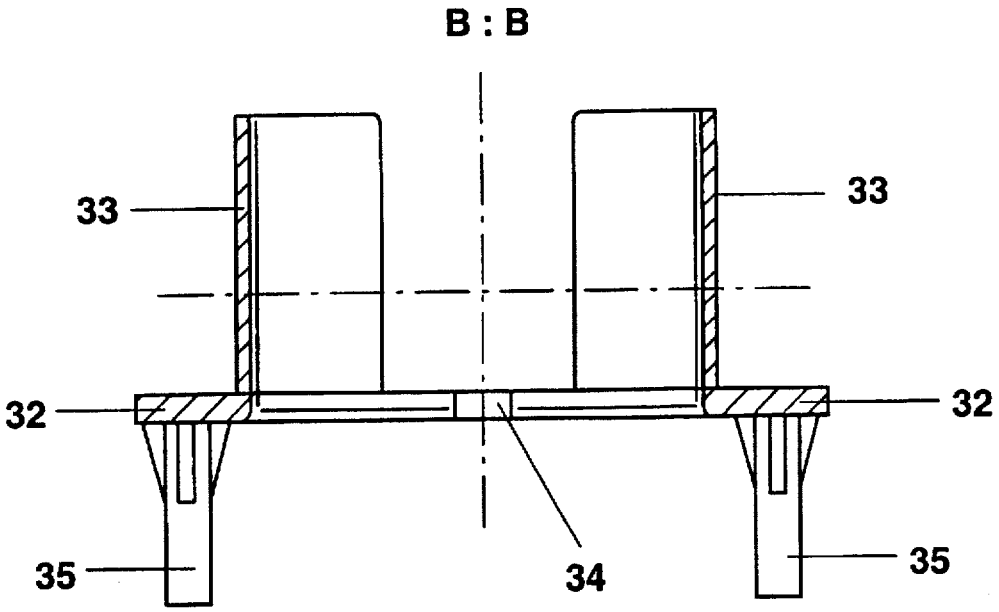

FIG. 11 shows this unit with two separating walls 33, plate 32, as well as spacers 35.

Figure 12:
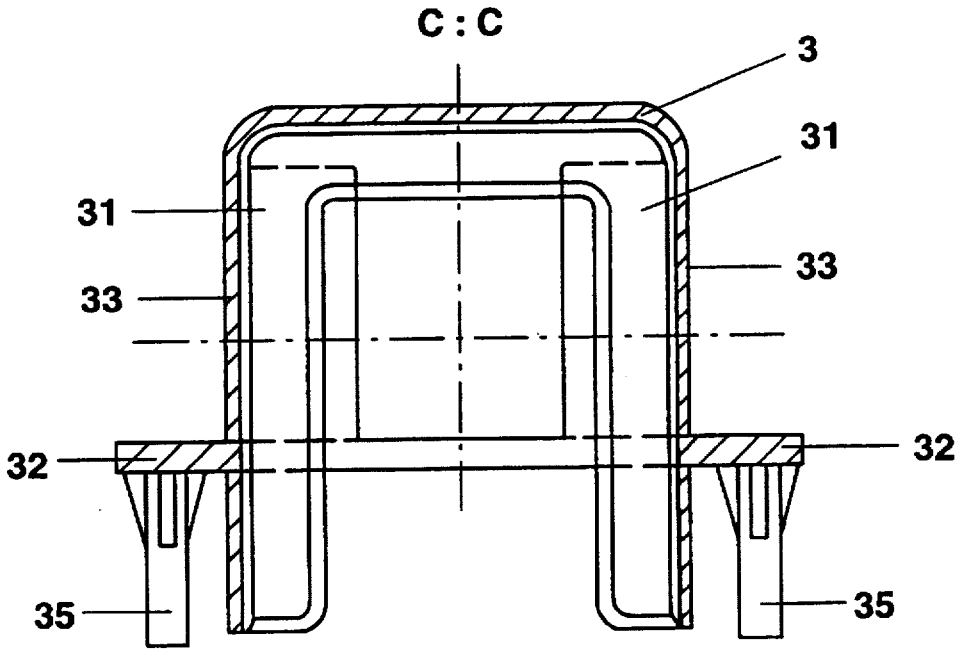
Figure 13:
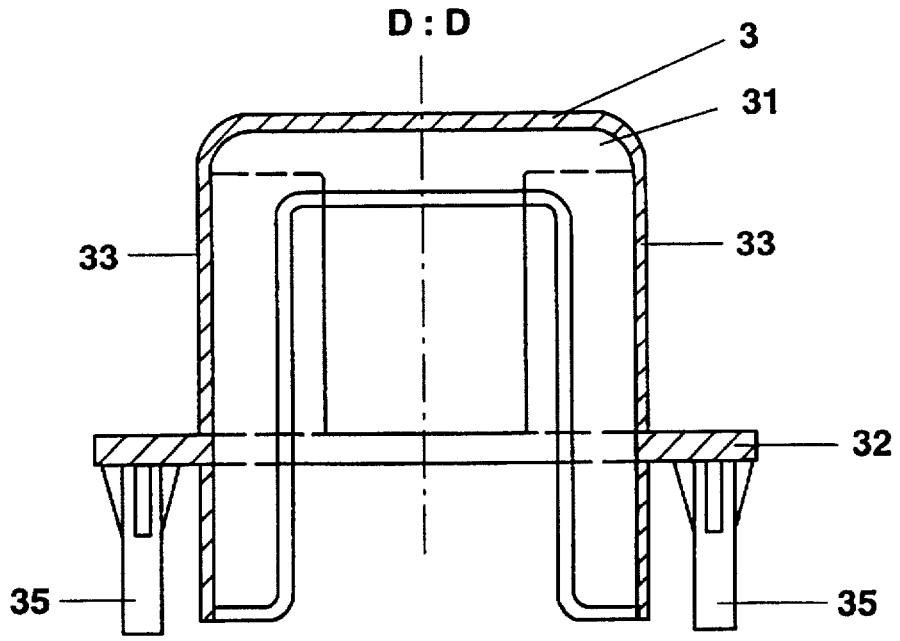

FIG. 12 shows section C—C according to FIG. 10 and FIG. 13 shows section D—D according to FIG. 10.

FIG. 14 again shows this unit from below, which is formed in one piece; it comprises the actual cap 3, first separating wall 31, plate 32, second separating walls 33, which can be shaped as in the figure, second coding element 34, as well as spacers 35.

Figure 14:
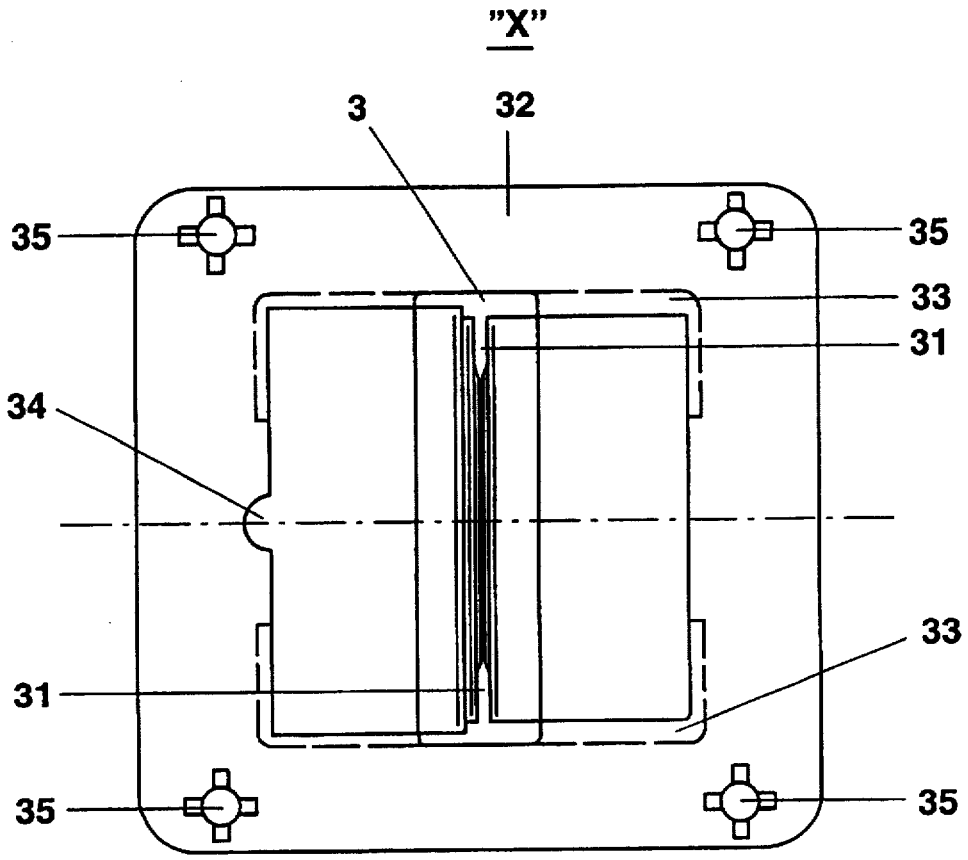

FIG. 15 shows a view of the unit shown in FIG. 14 from the top.

Figure 16:
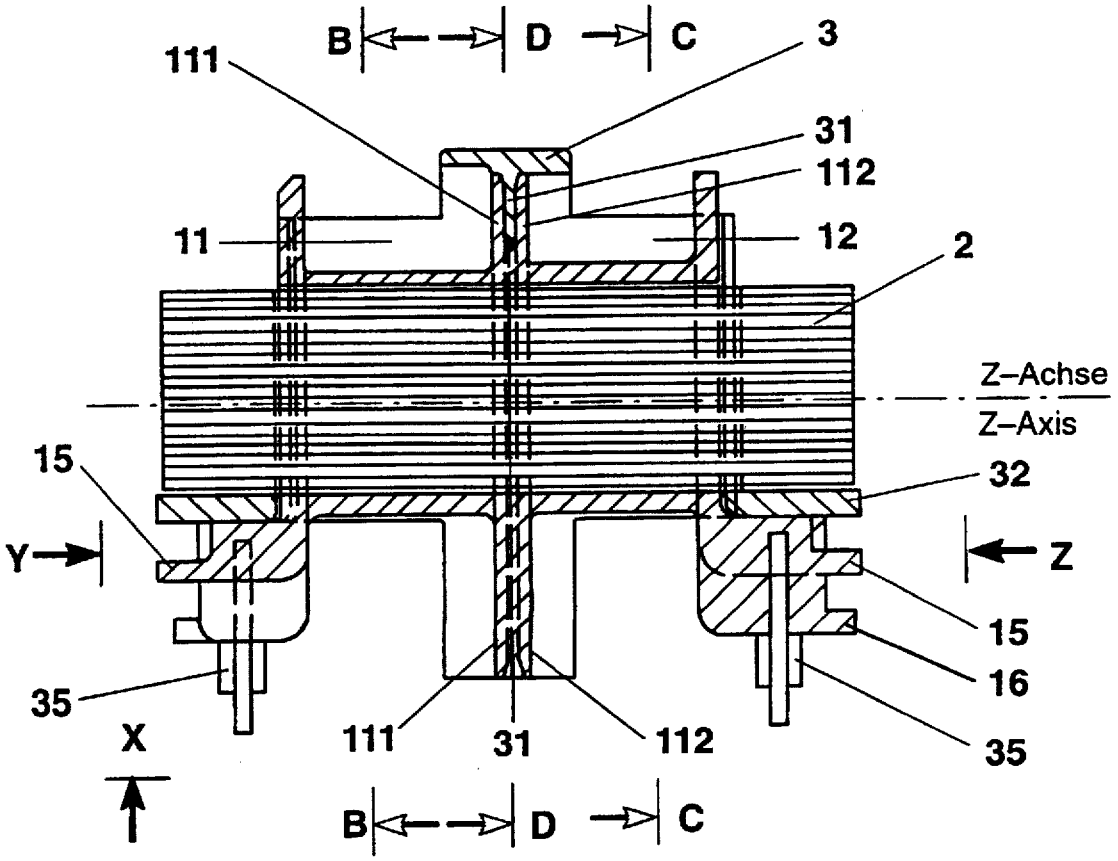
FIGS. 16–24 show one form of embodiment of the transformer of the invention.

FIG. 16 shows the transformer of the invention, which comprises the previously described winding unit 1, a ferrite core 2, as well as cap 3 with the connected components (31, 32, 33, 34 and 35), whereby first separating wall 31 lies between chamber walls 111 and 112.

Figure 17:
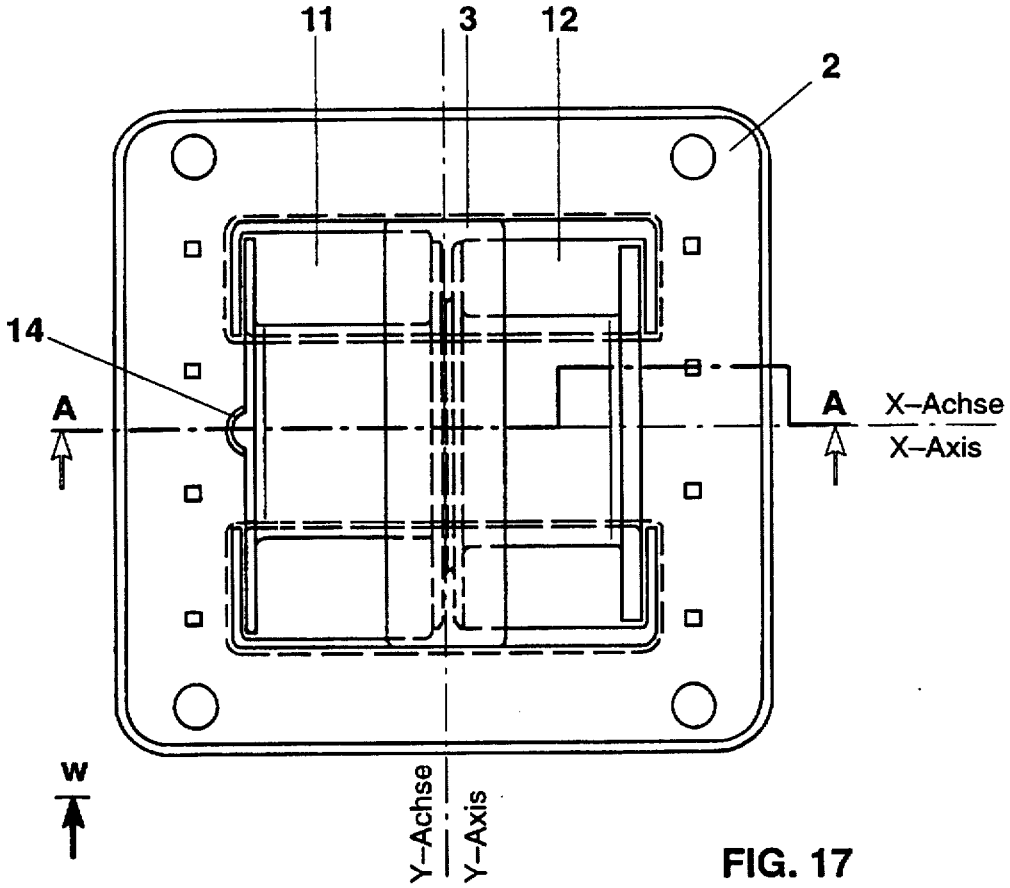
Figure 18:
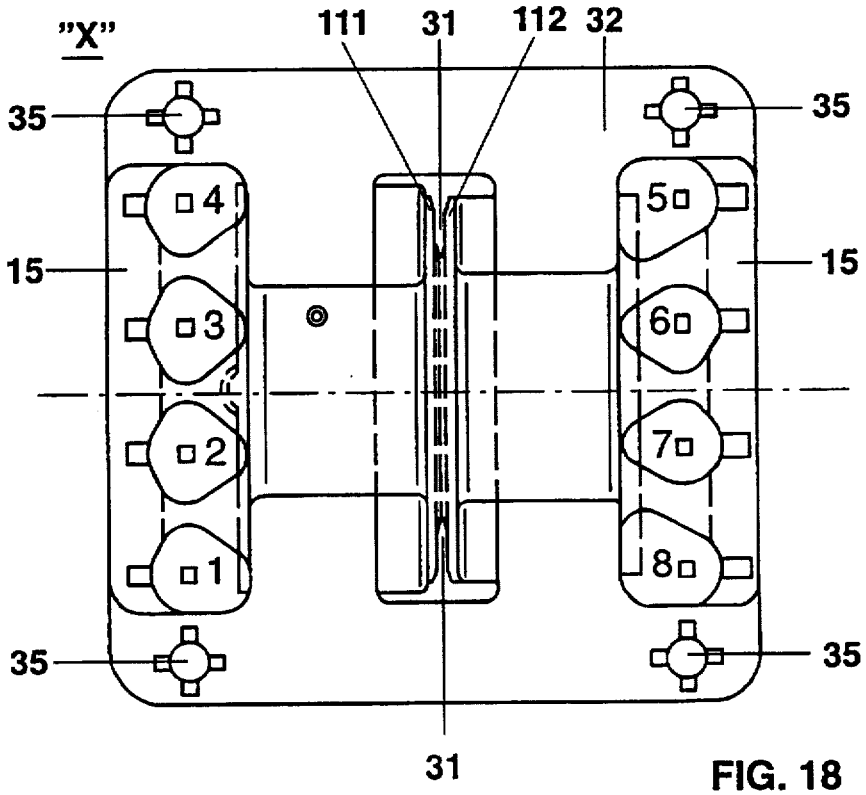

FIG. 17 is a view onto the transformer from the top, whereas FIG. 18 shows the transformer from below.

Figure 19:
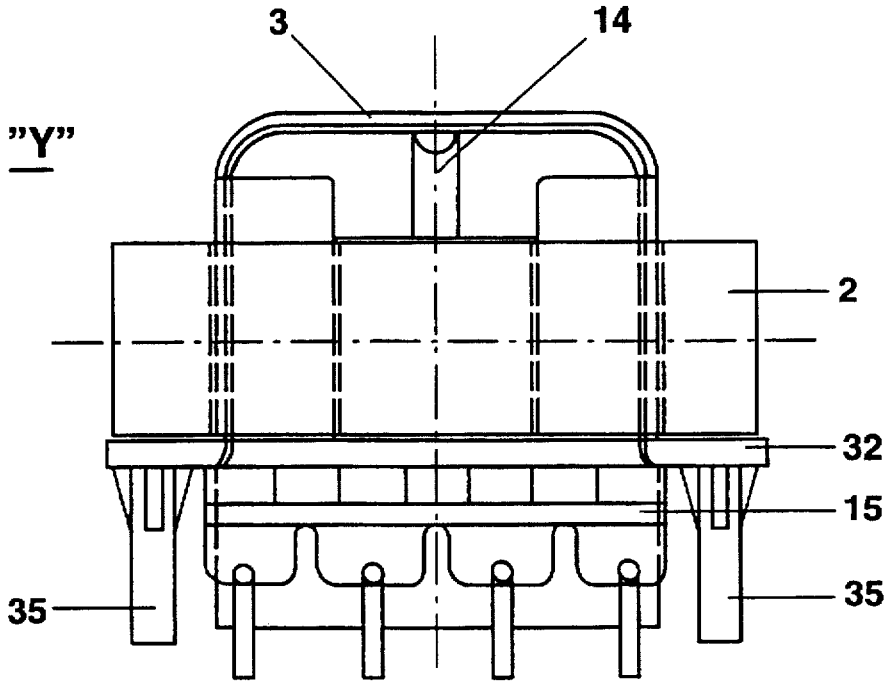
Figure 20:
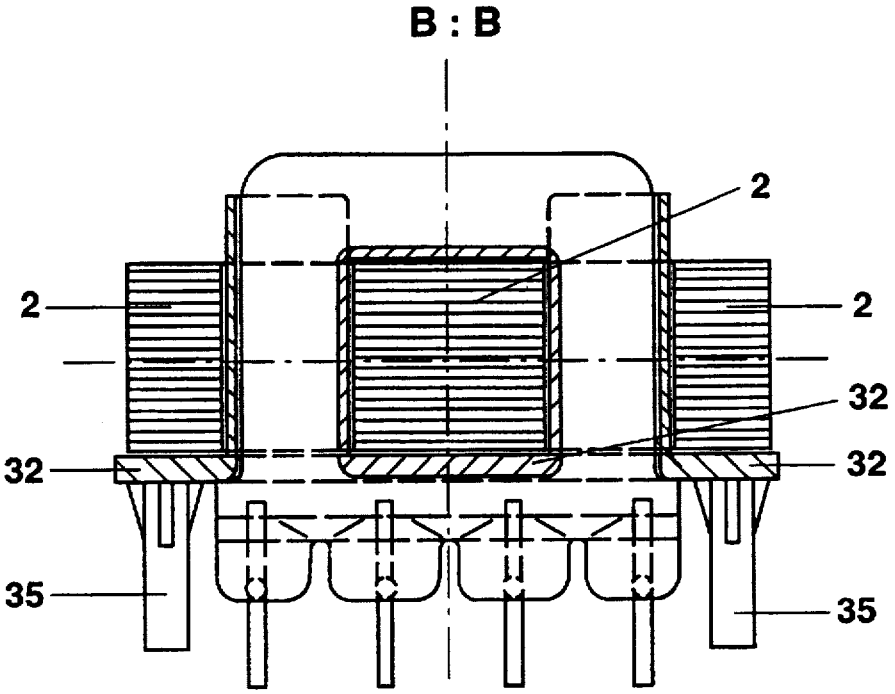
Figure 21:
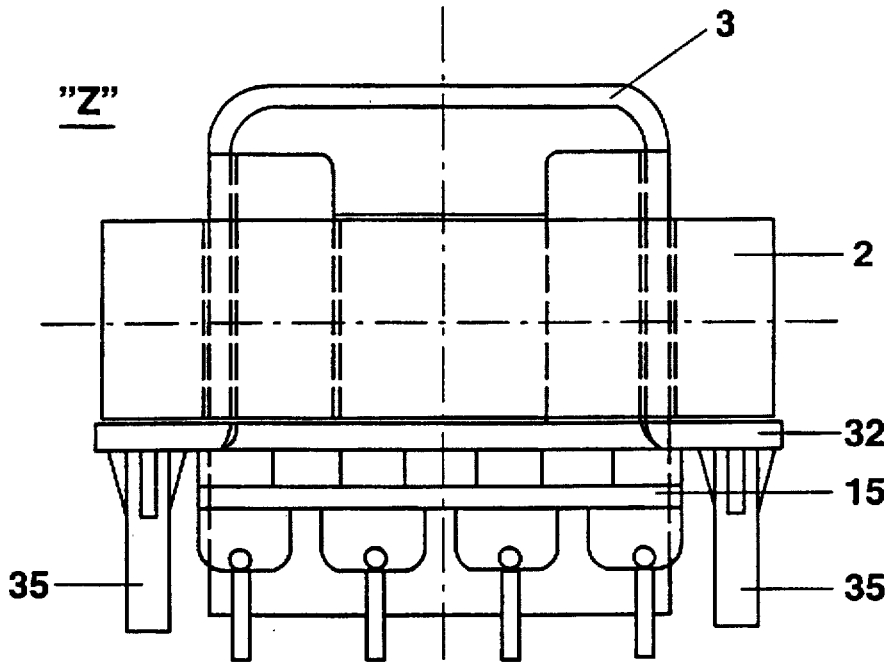
Figure 23:
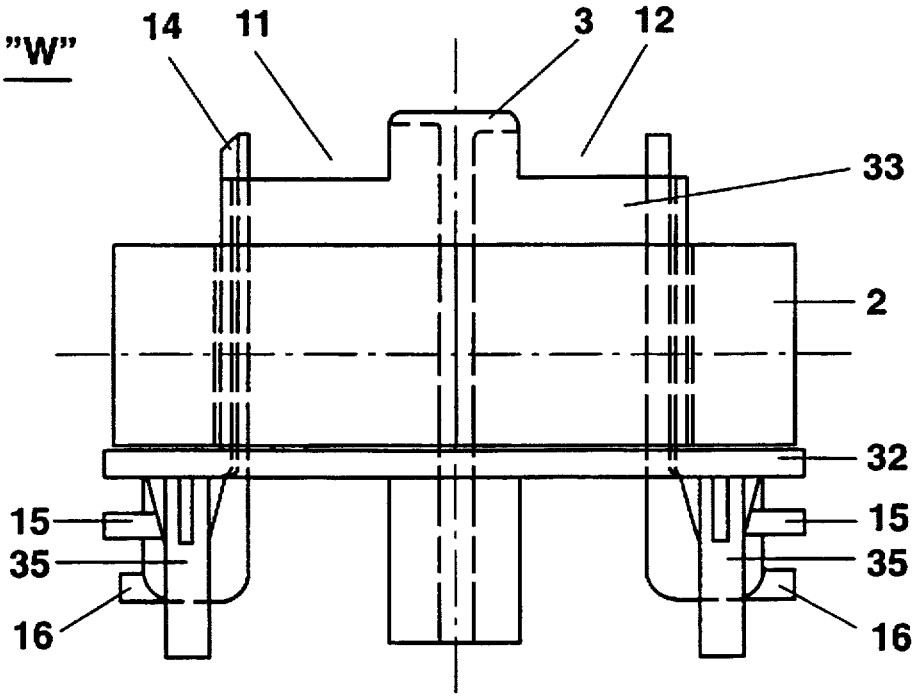
Figure 24:
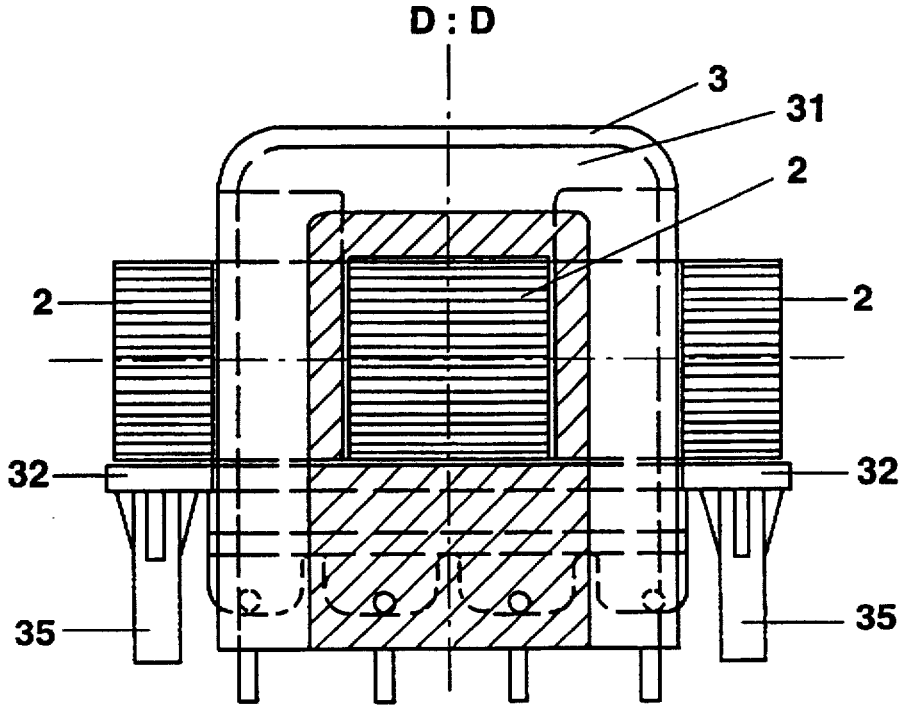

FIG. 19 shows the transformer from one side, whereas FIG. 20 shows a section through the transformer. FIG. 21 again shows a side view of the transformer, whereas FIG. 22 shows a section through the transformer. FIG. 23 also shows the transformer from the side, whereas FIG. 24 shows a section through the transformer.

Cap 3 or complex 3-31-33-32, on the one hand, and winding unit 1, on the other hand, are each comprised of plastic, which is used for transformers in a way known in and of itself.

What is claimed is:

1. A transformer with at least one primary winding and at least one secondary winding, with a winding unit (1) on which the primary winding is arranged in a first chamber (11) and on which the secondary winding is arranged in a second chamber (12), in which a core (2) is introduced, and which has an uptake element (13) for a cap (3), is hereby characterized by the fact that the cap (3) extends in opposite directions parallel to an axis defined by the first and second chambers so as to cover only a partial region of the primary winding and the secondary winding, and the primary winding and secondary winding in the partial region are adjacent to each other, and that the cap (3) is configured with an annular plate (32) arranged parallel to the cap (3), a first separating wall (31) essentially arranged perpendicularly to the cap (3), and the wall is arranged between the first chamber (11) and the second chamber (12) in an assembled state.

2. The transformer according to claim 1, further characterized in that the cap (3) and the first separating wall (31) are formed in one piece.

3. The transformer according to claim 2, further characterized in that the first chamber (11) has a first chamber wall (111) on its side turned toward the second chamber (12), that the second chamber (12) has a second chamber wall (112) on its side turned toward the first chamber (11), that the first chamber wall (111) and the second chamber wall (112) are configured in parallel and are distanced from one another such that the first separating wall (31) is arranged at least in a partial region between the chamber walls (111, 112) in the assembled state.

4. The transformer according to claim 2, further characterized in that the separating wall (31) is configured in a U shape having U leg pieces in the assembled state laterally surrounding a part of the core (2) arranged in the winding unit (1).

5. The transformer according to claim 1, further characterized in that spacers (35) are arranged on the annular plate (32).

6. The transformer according to claim 2, further characterized in that the cap (3) is joined with second separating walls (33), which are arranged between the first chamber (11) and the second chamber (12), and between the core (2), in the assembled state.

7. The transformer according to claim 6, further characterized in that the cap (3), the first separating wall (31), the annular plate (32) and the second separating walls (33) are formed in one piece.

8. The transformer according to claim 1, further characterized in that the winding unit (1) has a first coding element (14), which corresponds to a second coding element (34), which is arranged on the cap (3) or a part connected with the cap.

9. The transformer according to claim 1, further characterized in that a first air and leakage distance exists between the primary winding and the secondary winding.

10. The transformer according to claim 9, further characterized in that the first air and leakage distance runs along the cap (3).

11. The transformer according to claim 9, further characterized in that the first air and leakage distance runs along a first chamber wall (111), the first separating wall (31), and a second chamber wall (112).

12. The transformer according to claim 9, further characterized in that the first air and leakage distance amounts to at least 4.5 mm in the assembled state.

13. The transformer according to claim 12, further characterized in that the first air and leakage distance amounts to 4.8 mm in the assembled state.

14. The transformer according to claim 1, further characterized in that a second air and leakage distance exists between the primary winding and the core (2), and between the secondary winding and the core (2), the second air and leakage distance equals at least 2.0 mm.

15. The transformer according to claim 14, further characterized in that the second air and leakage distance between the primary winding and the core (2), and between the secondary winding and the core (2), equals 3 mm.

16. The transformer according to claim 1, further characterized in that the winding unit (1) has an insulating ridge (15) parallel to the core (2).

17. The transformer according to claim 3, further characterized in that the first chamber wall (111) and the second chamber wall (112) each have a wall thickness equal to 0.4 mm.

18. The transformer according to claim 2, further characterized in that the first separating wall (31) has a wall thickness equal to 0.6 millimeter.

* * * * *